US007318501B2

(12) United States Patent
Felder

(10) Patent No.: US 7,318,501 B2
(45) Date of Patent: Jan. 15, 2008

(54) ELEVATOR CONTROL APPARATUS WITH SIDE MOUNTED SIGNAL GENERATING INSERT

(75) Inventor: Hugo Felder, Buchrain (CH)

(73) Assignee: Inventio AG, Hergiswil NW (CH)

( * ) Notice: Subject to any disclaimer, the term of this patent is extended or adjusted under 35 U.S.C. 154(b) by 648 days.

(21) Appl. No.: 10/858,356

(22) Filed: Jun. 1, 2004

(65) Prior Publication Data

US 2004/0245052 A1 Dec. 9, 2004

(30) Foreign Application Priority Data

Jun. 4, 2003 (EP) ..... 03405404

(51) Int. Cl.
*B66B 7/00* (2006.01)

(52) U.S. Cl. ..... 187/414; 187/391

(58) Field of Classification Search ..... 187/414, 187/391–396, 397–399
See application file for complete search history.

(56) References Cited

U.S. PATENT DOCUMENTS 5,817,994 A * 10/1998 Fried et al. ..... 187/391
5,829,554 A * 11/1998 Benson et al. ..... 187/414
6,227,335 B1 5/2001 Koeppe, Jr. et al.
6,357,553 B1 * 3/2002 Vialonga ..... 187/385
6,508,334 B1 * 1/2003 Matsuda et al. ..... 187/391
2006/0054421 A1 * 3/2006 Ikeda ..... 187/395

FOREIGN PATENT DOCUMENTS

| | | |
|---|---|---|
| EP | 0 706 246 | 4/1996 |
| JP | 06156889 | 6/1994 |
| JP | 06271220 A * | 9/1994 |
| JP | 07277617 | 10/1995 |
| JP | 11228037 | 8/1999 |

* cited by examiner

*Primary Examiner*—Jonathan Salata
(74) *Attorney, Agent, or Firm*—Fraser Clemens Martin & Miller LLC; William J. Clemens

(57) ABSTRACT

A control apparatus for an elevator installation has actuating elements on a front surface. The control apparatus includes an insert in the form of a key-operated switch cylinder which has a recess or a key slot. The insert is mounted in a side surface that is one of a lateral side wall of a housing, an end surface of an elevator car handrail and a side surface of a column. The recess opens transversely to the front surface. A separate auxiliary actuating element is received into the recess in the direction of an axis extending parallel to the front surface. The insert is mechanically actuatable by rotation of the auxiliary actuating element about the axis in order to trigger specific functions in conjunction with the control of the elevator installation.

12 Claims, 1 Drawing Sheet

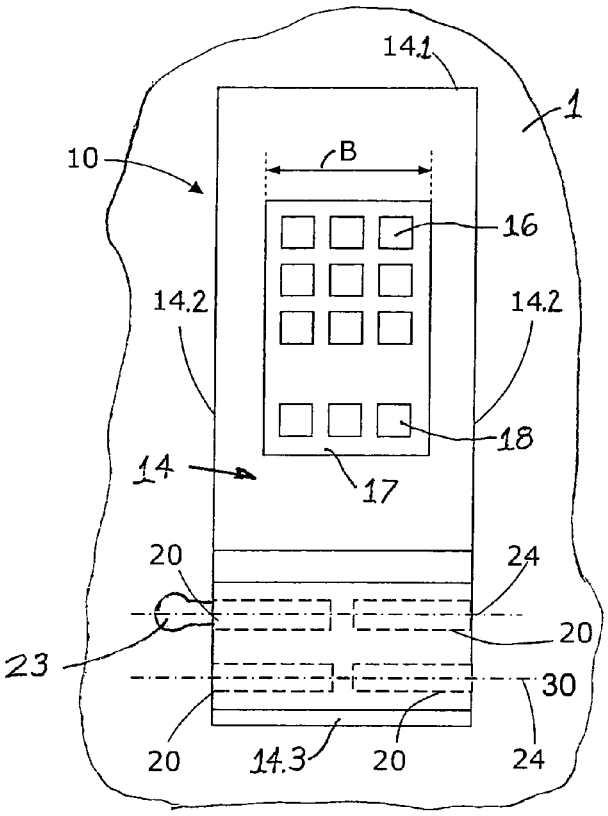
Fig. 1A
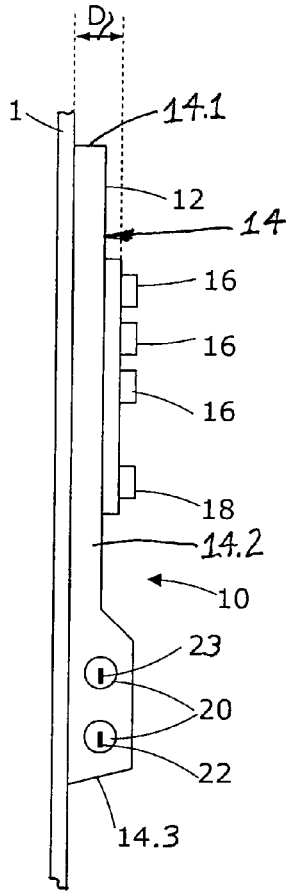
Fig. 1B
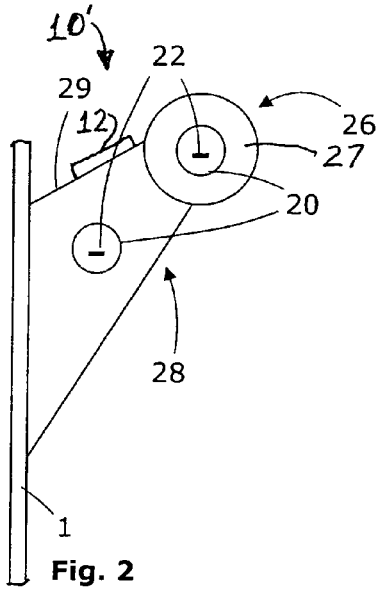
Fig. 2
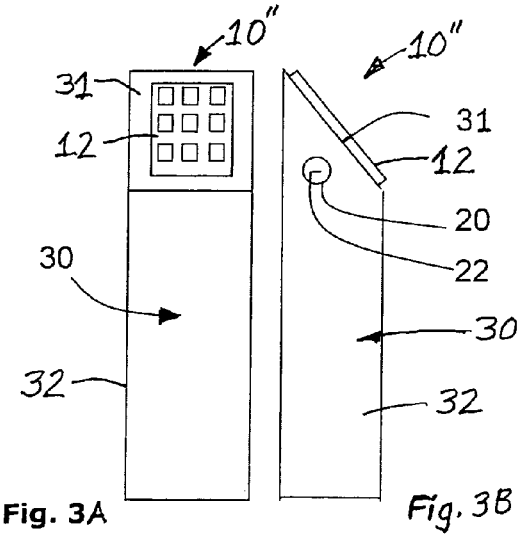
Fig. 3A
Fig. 3B

ELEVATOR CONTROL APPARATUS WITH SIDE MOUNTED SIGNAL GENERATING INSERT

BACKGROUND OF THE INVENTION

The present invention relates to a control apparatus for an elevator installation.

Elevator installations are in general actuated by way of a control apparatus which is also termed an indicator board and which contains a control panel. Such control apparatuses are usually present not only at individual floors, but also in the elevator car.

Control apparatuses of that kind are widely dispersed. They are mostly mounted at a wall, particularly at a vertical wall, or integrated in a wall. There are also control apparatuses installed in front of the wall and mounted in columns and accordingly at an angle to the vertical wall. However, control apparatuses can also be connected with the building or the elevator car only by way of cable connections, wherein such forms of embodiment are used almost exclusively for elevator installations for transporting goods. The control apparatuses of passenger elevators are preferably at least partly flush or almost flush with a wall so that they demand less space and are largely protected against damage.

A typical control apparatus of this kind is shown in European patent document 0 706 246-A1. Like other conventional control apparatuses, this control apparatus has a slightly inclined front surface that forms a control panel. The front surface can, however, also be arranged vertically. The front surface faces, depending on the respective position or function of the control apparatus, the waiting area in front of a shaft door of an elevator shaft or the interior of the elevator car. The front surface contains actuating elements such as, for example, buttons or, in a given case, also switches by which the elevator car can be called from a floor or a floor to be traveled to can be selected from the elevator car. Further buttons can be present which serve for, for example, opening and closing the car doors or by which the elevator car can be stopped or an emergency call set in motion or by which special functions can be initiated, for example fan, car light, etc. Indicating elements, particularly illuminated indicating devices, can be included in the front surface. In addition to buttons and indicating devices the control apparatuses have an insert or several inserts in the form of locks or key-operated switch cylinders, wherein each insert has a recess, which opens at the front surface, in form of a keyhole or key slot. There are also toggle switches with a lever, which can be used for functions such as, for example, fan, stopping or car light. The insert is intended for reception of a separate auxiliary actuating element in the form of a key that is introduced by way of the recess substantially perpendicularly to the front surface and is actuated rotationally. The auxiliary actuating element serves, in at least partial mechanical co-operation with the insert, for triggering specific special functions. Operation of the separate auxiliary actuating element generally lies in the hands of maintenance personnel of the elevator installation. In other cases, specially authorized users of the elevator installation use an auxiliary actuating element in order, for example, to travel by the elevator car to a floor which is reserved for them. In certain cases the auxiliary actuating element has to remain plugged in during travel of the elevator car.

A disadvantage of the above-described arrangement is, inter alia, the comparatively large depth or transverse dimension of the control apparatus perpendicularly to the front surface. This large transverse dimension is caused by the construction, arrangement and mode of actuation of the lock-like insert, for which a certain installation depth has to be available in the direction of pushing-in the auxiliary actuating element or key. As a consequence thereof the control apparatus has to be set far into the wall so that this wall has to have a passage. If no such passage is present or possible, then the control apparatus projects into the free space in front of the wall which is not desirable for operating and aesthetic reasons. An end of the key projecting out of the lock or key-operated switch cylinder is frequently broken off by transported goods, which then has the undesired consequence that the elevator installation is blocked.

A control apparatus is shown in the Japanese patent document 06 156889 which has only a small transverse dimension. In this control apparatus the usual actuating elements, such as, for example, buttons, lie at the front surface. As a separate auxiliary actuating element there is used not a mechanically acting key, but a chip card which co-operates with a corresponding insert in the control apparatus. This insert has a slot-shaped recess in which the card can be inserted by a translational movement parallel to the front surface and thus parallel to the wall. The disadvantage of this control apparatus resides in the fact that a chip card is not suitable as an auxiliary actuating element in the same way as a mechanical key. The chip card can be more easily damaged in handling and storage than a metallic key and it requires for its function costly electronic auxiliary equipment. A further disadvantage of the chip card relative to a key resides in the fact that when a key is inserted it is recognizable at the key position in what way it acts or should act, which is not the case with the chip card. A further disadvantage of the chip card solution is that is functions only when the electronic system of the control apparatus is supplied with supply voltage and or other electronic components are ready for use.

It is now an object of the present invention to propose an apparatus of the kind stated above by which the disadvantages of the devices according to the state of the art are avoided. Amongst other things, the control apparatus shall have a small depth or transverse dimension, it shall be secure against vandalism and resetting or function of the inserted auxiliary actuating element should be recognizable from the outside. In addition, the insert shall be conceived in such a manner that the separate auxiliary actuating element can be produced in problem-free manner and can be stored without the risk of damage. Moreover, the insert shall be so constructed that only specific auxiliary actuating elements are usable, so that only a specific circle of persons can use the control apparatus.

SUMMARY OF THE INVENTION

The present invention concerns a control apparatus that has, as an insert, a lock or key-operated switch cylinder. This insert has a recess for reception of a separate auxiliary actuating element, which is not integral with the control apparatus, in the form of a key. The recess opens at an opening surface, which is arranged at least approximately perpendicularly to the front surface of the control apparatus.

The opening surface is in general a side surface of the control apparatus. This opening surface is, in the case of a fastened control apparatus, oriented transversely to the wall of the building or the elevator car at which the control apparatus is mounted. The key-like auxiliary actuating element has to be introduced at least approximately parallel to the front surface or to the wall of the building or the elevator car, wherein it moves in the direction of an axis. In the case of rotation about this axis, an action is exerted on a switch arrangement of the key-operated switch and a special function thereby triggered. The axis about which the auxiliary switching element is rotatable extends at least approximately parallel to the front surface of the control apparatus or to the vertical wall of the building or the elevator car.

The switch arrangement is in general conceived in such a manner that it can be termed an electromechanical switch arrangement. The auxiliary actuating element and the switch arrangement co-operate, whereby a switching, switching-over or sensing takes place. Thus, two or more positions are possible. Due to the fact that it is an electromechanical switch arrangement, no (complicated) electronic system for reading and operating is required such as is the case with the chip card solution described above. It is therefore possible to realize emergency functions, which are denied to chip card use, by a use based on a key switch. For example, a key switch can be used in such a manner that in the case of fire a capability of control is ensured even with reduced current supply.

The new control apparatus according to the present invention has numerous advantages, of which the most important are listed in the following. The new control apparatus has a small transverse dimension or depth notwithstanding use of a mechanically acting auxiliary actuating element or key, because the path, which is necessary for the lock and the key, in the direction of the axis lies parallel or approximately parallel to the front surface.

A further advantage of the new control apparatus is that an inserted auxiliary actuating device such as, for example, a key no longer protrudes transversely from the front surface. It is thus possible to avoid such a key being deformed or broken off or injuring anybody.

The key used as an auxiliary actuating element is, by comparison with a chip card, simpler in production, the risk of damage in storage and handling is less, no costly and easily disturbed elements are required in the insert and the setting of the key is recognizable from the outside. As with the chip card it can also be guaranteed by a suitable key that actuation of the insert is restricted to specific selectable auxiliary actuating elements.

The receptacle for the auxiliary actuating element, i.e. the key slot, is less noticeable and therefore less conducive to vandalism.

The arrangement according to the present invention can also be provided at a free control apparatus which is not fixedly installed and which can therefore be designed to be flatter and handier. The arrangement according to the present invention is, however, particularly advantageous at a fixedly installed control apparatus.

In the case of a fixedly installed control apparatus the front surface can be vertical or slightly inclined in a desk-like manner, wherein in the latter case the insert is preferably arranged in that region of the control apparatus which projects furthest from the vertical wall.

The recess into which the auxiliary actuating element or the key is introduced can lie at any side wall of the control apparatus. Lateral recesses or keyholes or key slots facilitate introduction of the auxiliary actuating element. Recesses or keyholes or key slots which are accessible from above or below have the advantage that they are less noticeable by users of the elevator installation and thereby less conducive to vandalism, for example by introducing foreign bodies such as chewing gum or matches.

In general there is used as an auxiliary actuating element, as already mentioned, a key. This is mostly a flat key, but a polygon key or a form of a screwdriver can also be provided as auxiliary actuating element.

The use of correspondingly constructed auxiliary actuating elements allows restriction of actuation of the new control apparatus and thus influencing of the elevator installation to specific auxiliary actuating devices which are substantially complementary to the auxiliary actuating element.

The insert or key-operated switch cylinder is generally arranged in a common housing with the control apparatus itself. The control apparatus can, however, be extended in such a manner that it also comprises a handrail arrangement or a section of a handrail arrangement. In this case the insert can be arranged in the handrail or in a handrail support. It is essential only that the introduction of the auxiliary actuating element or key takes place at least approximately parallel to a wall of the building or the elevator car at which the control apparatus is mounted.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1A is a front elevation view of a control apparatus for an elevator installation according to the present invention;

FIG. 1B is a side elevation view of the control apparatus shown in FIG. 1A;

FIG. 2 is an end view of a handrail of an elevator car in which an insert of a control apparatus according to the present invention is received;

FIG. 3A is a front elevation view of a control apparatus according to the present invention mounted in a column; and FIG. 3B is a side elevation view of the control apparatus and column shown in FIG. 3A.

DESCRIPTION OF THE PREFERRED EMBODIMENT

FIGS. 1A and 1B show a control apparatus 10 according to the present invention that is mounted on a surface of a vertically extending wall 1 and which is usable for control of an elevator installation. The wall 1 can be a wall of a building in the vicinity of an elevator shaft or a wall of an elevator car. The control apparatus 10 has a front surface 12 that, in the present example of an embodiment, is oriented parallel or at a slight angle to the wall 1. The control apparatus 10 includes a housing 14 formed by the front surface 12 and four side walls which are oriented transversely to the wall 1. The side walls include an upper side wall 14.1 and lateral side walls 14.2 that are, in the present example of an embodiment, oriented perpendicularly to the wall 1 and a lower side wall 14.3 that is inclined at a slight angle downwardly toward the wall 1. The inclination could also be in the upward direction.

A control panel 17 with actuating elements 16 or buttons, as well as a row with actuating elements 18 for special functions (door opening, door closing and alarm) is disposed in the upper part of the control apparatus 10. The actuating elements 16 and 18 are manually actuatable for generating signals to an elevator control (not shown). Two inserts 20 or key-operated switch cylinders 20 are respectively received in a lower part of each of the lateral side walls 14.2 of the control apparatus 10. The number of key-operated switches is not limited; here by way of example, there are two units per side. The inserts 20 or key-operated switch cylinders 20 are intended for the purpose of being actuated with the help of an auxiliary actuating element 23, which is in the form of a key, to generate signals to the elevator control in order to trigger specific functions of the elevator installation. Each of the inserts 20 or key-operated switch cylinders 20 has a recess 22 or a key slot 22 in which the auxiliary actuating element 23, i.e. the key, can be introduced linearly or possibly helically in the direction of an axis 24. The auxiliary actuating element 23 introduced into the insert 20 is rotatable about the axis 24. The axis 24 is, in the present example of embodiment, horizontal and it is aligned, in accordance with the invention, at least approximately parallel to a plane of the wall 1.

Because the auxiliary actuating element 23 is inserted into the receptacle 22 parallel to plane of the wall 1 it does not protrude frontally beyond the front surface 12 or the control panel 17. The risk that an end of the auxiliary actuating element 23 protruding out of the insert 20 or key-operated switch cylinder 20 is broken off or bent out of shape is thereby virtually excluded.

The largest dimension of the insert 20 or of the key-operated switch cylinder 20 extends in the direction of the axis 24. Because the insert 20 or the key-operated switch cylinder 20 is so arranged that its axis 24 and thus its largest dimension lies parallel or approximately parallel to the plane of the wall 1, a thickness D of the control apparatus 10 and/or a transverse dimension B of the control panel 17 can be kept comparatively small.

FIG. 2 shows a handrail arrangement such as is frequently present in elevator cars. The handrail arrangement comprises an actual, here tubular, handrail 26 and several handrail supports 28, only one of which is shown, which are mounted at spaced locations on the car wall 1 and on which the actual handrail 26 is supported. A control apparatus 10' according to the present invention can be arranged on, for example, an upwardly facing surface 29 of one of the handrail supports 28. The insert 20 or the key-operated switch cylinder 20 is arranged in an end surface 27 of the handrail 26 so that the corresponding region of the handrail 26 together with the key-operated switch can be considered to be a part of the control apparatus 10'. This arrangement is very space efficient, since the rest of the control apparatus can be comparatively small, because it does not have to receive the insert 20 or the key-operated switch cylinder 20.

In a preferred embodiment the insert 20 is so constructed that only one or more substantially complementary auxiliary actuating elements 23 or sets of auxiliary actuating elements are accepted. Thus, for example, the use of the elevator car can be restricted to a specific circle of persons in which each of the persons has a key of a suitable key set.

According to a further embodiment the auxiliary actuating element 23 can, after actuation of the built-in key-operated switch, be removed from the keyhole, wherein the key-operated switch, however, remains in the desired switch setting. This is a further distinction in relation to the chip card solutions which were explained above and which function only if the chip card remains in the slot of the control apparatus.

A further possibility is also the installation of the key-operated switch cylinder, in the case of appropriate construction, directly in the handrail support 28 if the end of the handrail has to be inclined towards the wall.

FIGS. 3A and 3B show a further embodiment of the present invention wherein a control apparatus 10" is fastened at or in a column 30, mounted on a front surface 31 thereof, and wherein at least a region of the front surface 12 of the control apparatus 10" extends at least approximately parallel to the front surface 31 of the column 30. The insert 20 with the key slot 22 is mounted on a side surface 32 of the column 30.

In each of the embodiments described above, the setting or rotational position of the insert 20 can be ascertained by observing either the position of the end of the auxiliary actuating element 23 protruding from the recess 22 or rotational position of the recess after the auxiliary actuating element has been removed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A control apparatus for an elevator installation comprising:

a housing having a front surface;

a plurality of actuating elements mounted at said front surface for generating signals to an elevator control;

at least one side surface;

an auxiliary actuating element; and an insert having a recess and being mounted at said at least one side surface, said recess adapted to receive said auxiliary actuating element along an axis, said insert being mechanically actuatable by rotation of said auxiliary actuating element about said axis for generating a signal to the elevator control triggering predetermined functions of the elevator control, and whereby when said housing is mounted on a mounting surface extending transverse to said at least one side surface with said axis extending generally parallel to said front surface, said auxiliary actuating element received in said recess extends generally parallel to said front surface.

2. The control apparatus according to claim 1 wherein the mounting surface is a surface of a vertical wall, said housing includes said at least one side surface, and said front surface extends generally parallel to the wall when said housing is mounted on the mounting surface.

3. The control apparatus according to claim 2 wherein said at least one side surface is a lateral side surface of said housing.

4. The control apparatus according to claim 1 wherein said insert is a key-operated switch cylinder which has a key slot as said recess for reception of said auxiliary actuating element which is formed as a key.

5. The control apparatus according to claim 1 including another insert having a recess for receiving another auxiliary actuating element, said another insert being mounted on one of said at least one side surfaces and another side surface extending transverse to said front surface.

6. The control apparatus according to claim 1 wherein said auxiliary actuating element is a first auxiliary actuating element, including a second auxiliary actuating element different from said first auxiliary actuating element and wherein said insert is mechanically actuatable by said first and second auxiliary actuating elements.

7. The control apparatus according to claim 1 wherein said insert is mechanically actuatable by a plurality of substantially complimentary auxiliary actuating elements.

8. The control apparatus according to claim 1 wherein a setting of said insert is ascertainable by observing a position of an end of said auxiliary actuating element protruding from said recess.

9. The control apparatus according to claim 1 wherein said at least one side surface is an end surface of a handrail mounted in an elevator car.

10. The control apparatus according to claim 1 wherein said at least one side surface and the mounting surface are formed on a column, the mounting surface being a front surface of the column and said at least one side surface being a side surface of the column.

11. The control apparatus according to claim 1 the mounting surface is formed on a handrail support mounted in an elevator car.

12. A control apparatus for an elevator installation comprising:

a housing having a front surface and a pair of lateral side surfaces;

a plurality of actuating elements mounted at said front surface for generating signals to an elevator control; and at least two inserts each having a recess and being mounted at an associated one of said lateral side surfaces, said recesses adapted to receive associated auxiliary actuating elements along an axis, each said insert being mechanically actuatable by rotation of said associated auxiliary actuating element about said axis for generating a signal to the elevator control, and whereby when said housing is mounted on a mounting surface extending generally parallel to said front surface, said auxiliary actuating elements received in said recesses extend generally parallel to said front surface.

* * * * *